US005894892A

United States Patent [19]

Huang

[11] Patent Number: 5,894,892

[45] Date of Patent: Apr. 20, 1999

[54] STRUCTURE OF FIRE EXTINGUISHING BOMBS

[76] Inventor: Chien-Ming Huang, 3F1, No. 16, Lane 65, Li Ming Rd., Hsin Tien City, Taipei Hsien, Taiwan

[21] Appl. No.: 08/882,404

[22] Filed: Jun. 25, 1997

[51] Int. Cl.[6] ..... A62C 8/00

[52] U.S. Cl. ..... 169/36; 169/58

[58] Field of Search ..... 169/36, 58

[56] References Cited

U.S. PATENT DOCUMENTS

| | | | |
|---|---|---|---|
| 392,671 | 11/1888 | Galbraith | 169/36 |
| 2,218,856 | 10/1940 | Roessner | 169/36 |
| 2,359,573 | 10/1944 | MacKay | 169/36 |
| 3,782,476 | 1/1974 | Leach | 169/1 |
| 3,918,526 | 11/1975 | Hattori et al. | 169/51 |
| 3,980,139 | 9/1976 | Kirk | 169/36 |
| 4,696,347 | 9/1987 | Stolov et al. | 169/46 |
| 5,626,787 | 5/1997 | Porter | 169/46 |

*Primary Examiner*—Andres Kashnikow
*Assistant Examiner*—Lisa Ann Douglas
*Attorney, Agent, or Firm*—Bacon & Thomas, PLLC

[57] ABSTRACT

A fire extinguishing bombs which includes the holding parts at both ends of the structure for holding a sealed glass container with fire extinguishing chemicals provided inside; the container is formed expanded in the central part to shape into a football-like body for increasing the spurting range in explosion. Furthermore, the fire extinguishing chemicals in the container is mingled with a number of beads containing also fire extinguishing chemicals for a second spurting of the chemicals by their bouncing and spattering when they fall on the ground, so as to enlarge the covering area and increase the effect of extinguishing a fire.

11 Claims, 4 Drawing Sheets

STRUCTURE OF FIRE EXTINGUISHING BOMBS

BACKGROUND OF THE INVENTION

The present invention concerns a structure of the fire extinguishing bomb.

A conventional and standard structure of a fire extinguishing bomb is usually a sealed glass container containing fire extinguising chemicals for casting or dropping in a fire.

Under the regulations of the above mentioned standard, it is the minimum require to have a fire extinguishing test of the bomb at a windless ground within one square meter. However in practice, persons skilled in fire fighting are all aware that the larger area covered by the fire extinguishing bomb, the better effect is expected.

It is known by persons familiar with physical knowledge that under the gravity influence, as shown in FIG.1, the suspended fire extinguishing bomb(1) held by the hook grooves of the holder(5) will spatter the fire extinguishing chemicals contained inside vertically down on the ground as it is explored by the heat. Therefore, in the covering area (A) observing from a plan circle square, the closer to the vertically downbelow spot of the bomb location, the more spattered amount of the chemicals heaped up therewith which cost a waste of the chemicals in the central area. Therefore, it is acknowledged that an enlargement of the spattering range of the fire extinguishing chemicals can be practically helpful for extinguishing a fire.

SUMMARY OF THE INVENTION

The object of this invention is to provide a fire extinguishing bomb which performs a better explosive force as it is explored by the heat in a fire to allow a well spurting and extending of the covering range of the chemicals inside the bomb.

Another object of this invention is to provide a fire extinguishing bomb which improves the fire extinguishing effect.

A further object of this invention is to provide a fire extinguishing bomb, in which the fire extinguishing chemicals can perform a second spurting, when it is spattered on the ground, to enlarge the covering area.

To achieve such object, the present invention is designed to have a sealed container with a holding part at each end and whose central part is expanded outward to shape into a football-like container, so as to achieve a full range of the explosive directions of the chemicals when the container is explored by the increased temperature. Furthermore, this invention is designed with a number of hollow beads, containing fire extinguishing chemicals, mingled within the chemicals in the sealed container. By the bouncing and spattering of the beads as they fall on the ground, the fire extinguishing chemicals can be spurted farther and therefore enlarge the fire extinguishing area and obtain a better effect. The above mentioned hollow beads may contain various fire extinguishing chemicals, so that a fire extinguishing bomb is provided with at least two different chemicals to be applied extendedly in complicated types of fires.

The foregoing features and advantages of the structure of this invention will be more clearly understood from the following drawings and detailed description.

DETAILED DESCRIPTION OF THE PREFERRED EMBODIMENTS

Figure 1:
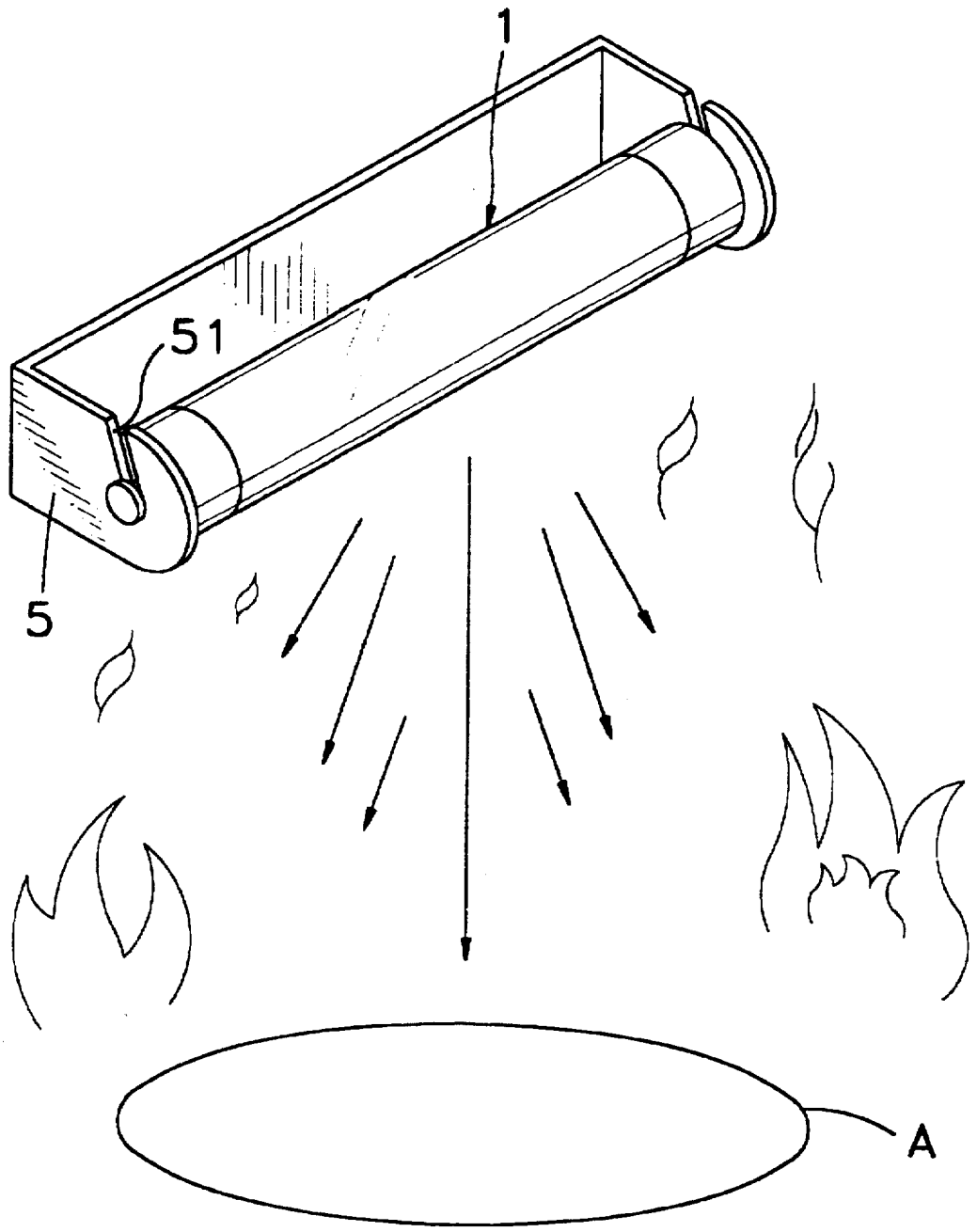
FIG. 1 is a perspective view showing the covering area of a conventional fire extinguishing bomb as it is explored.
Figure 2:
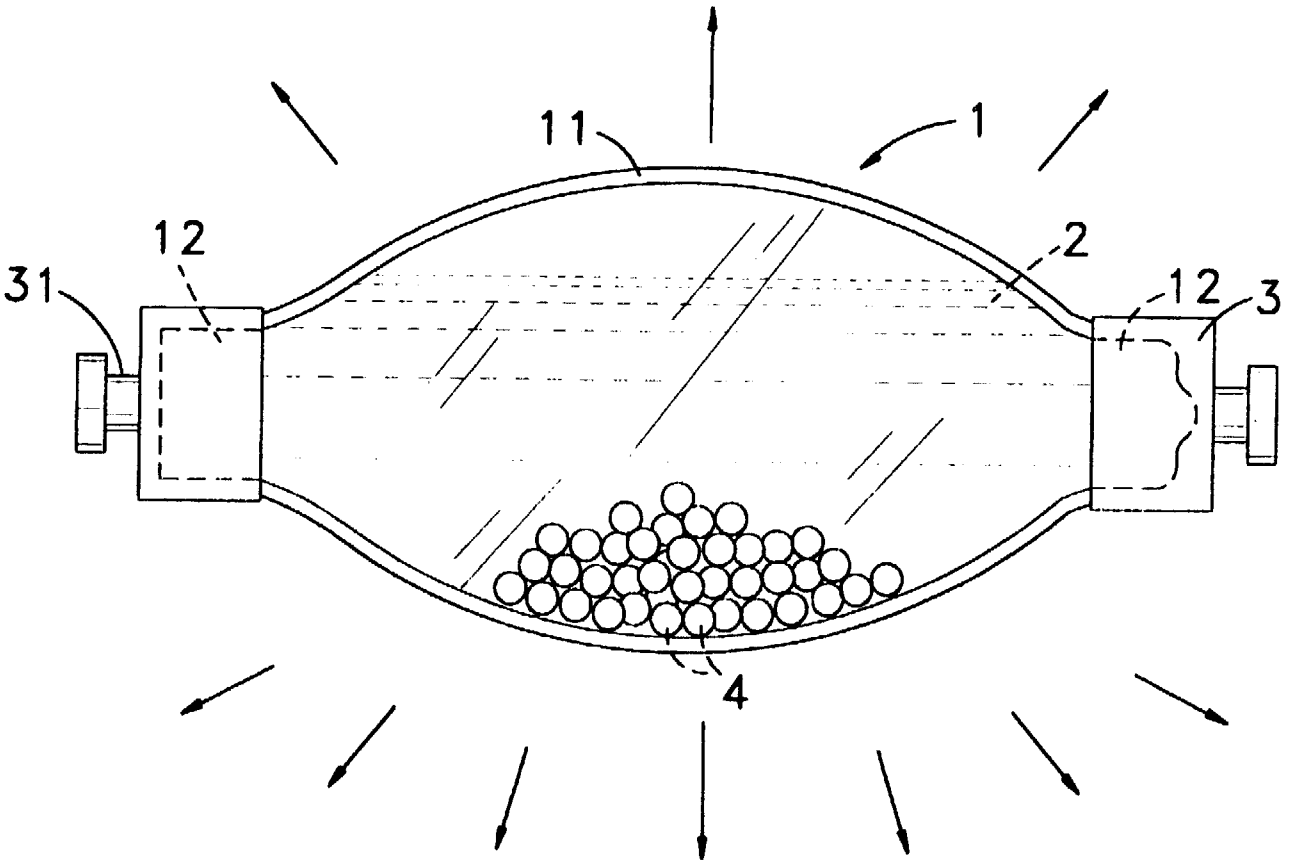
FIG. 2 is a sectional view showing the embodiment of the structure of the present invention.

The fire extinguishing bomb of the present invention is available for extinguishing a fire by casting it thereto. However, it performs a superior effect especially when it is located suspendedly in static. Shown in FIGS. 2–5, and reference to FIG. 1, the fire extinguishing bomb of the present invention is able to be suspended on a beam, a ceiling, a wall or other appropriate locations by the hook grooves (51) of the holder (5).

The present invention essentially consists of: a sealed hollow container (11), in which the central part is expanded outward and therefrom extended to both ends with gradual narrowing into a holding part (12); and the fire extinguishing chemicals (2) filled in the container (11) which, with a temperature raised by the fire, will expand its volume and gasify rapidly to form a pressure for bloating the container (11) and allowing the fire extinguishing chemicals to spurt. It is better to have a metal protector (3) casing over the holding part (12) and preferably provided with a neck (31) for hanging at the above mentioned holder (5). The container (11) is preferably made of heat-resisting fracturable glass with low expansion coefficient so as to be explored into small pieces as good as possible. According to the applicant's research, a conventional fire extinguishing bomb made of safety glass with higher expansion coefficient is usually exploded into chips which might cause a second injury to people in a fire. It is obviously inferior to the design of the present invention.

Figure 3:
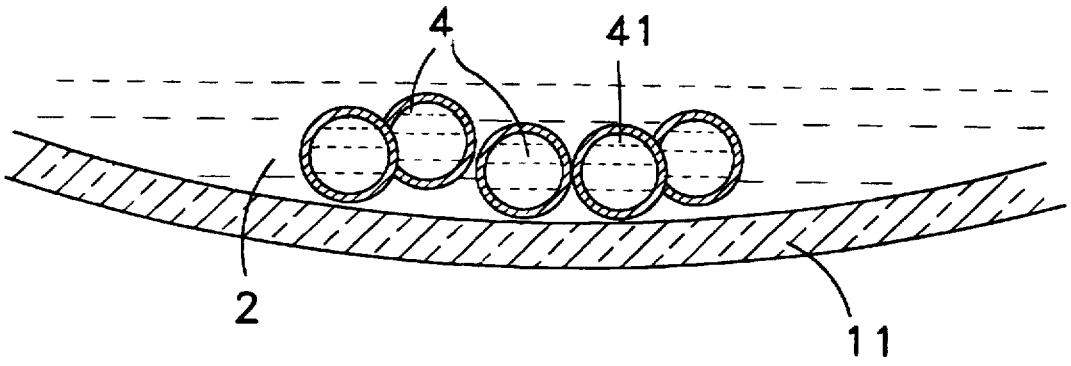
FIGS. 3 and 4 are respective partially enlarged sectional views of FIG. 2 showing the different embodiments of the present invention.
Figure 4:
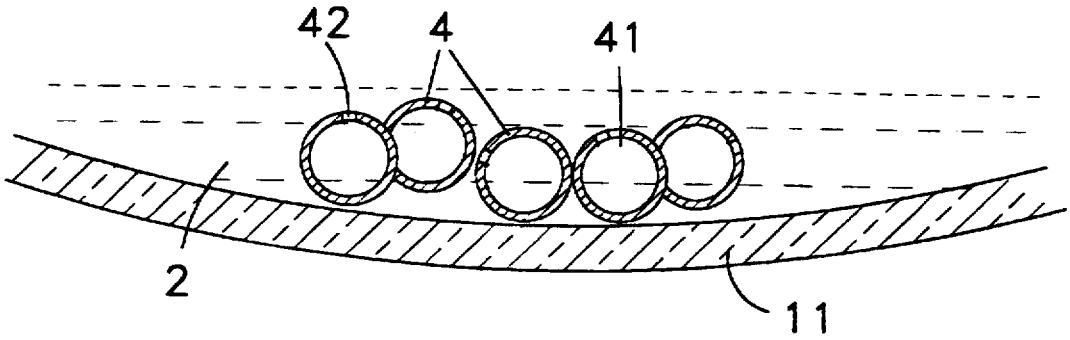

The container (11) contains multiple hollow beads (4), as shown in FIG. 3, which are sealed and preserved in advanced with fire extinguishing chemicals, and an alternative embodiment in FIG. 4 shows the beads (4) with respectively a hole (42) for the fire extinguishing chemicals inside the container (11) to flow in. The foregoing example in FIG. 3 performs an outstanding effect in extinguishing the fire. Conventional fire extinguishing bombs provided with only one kind of chemical is available for extinguishing only a certain type of fire, for example type A fire; but the beads (4) in the present invention containing different chemicals which is available for extinguishing type B fire enable the fire extinguishing bomb of the present invention to extinguish a fire of mixed types. The container (11) may contain various appropriate fire extinguishing chemicals whether in the form of liquid, powder, or static one. The example of a liquid mixture will consist of at least ammonium sulphate, urea, ammonium chloride and sodium carbonate.

Figure 5:
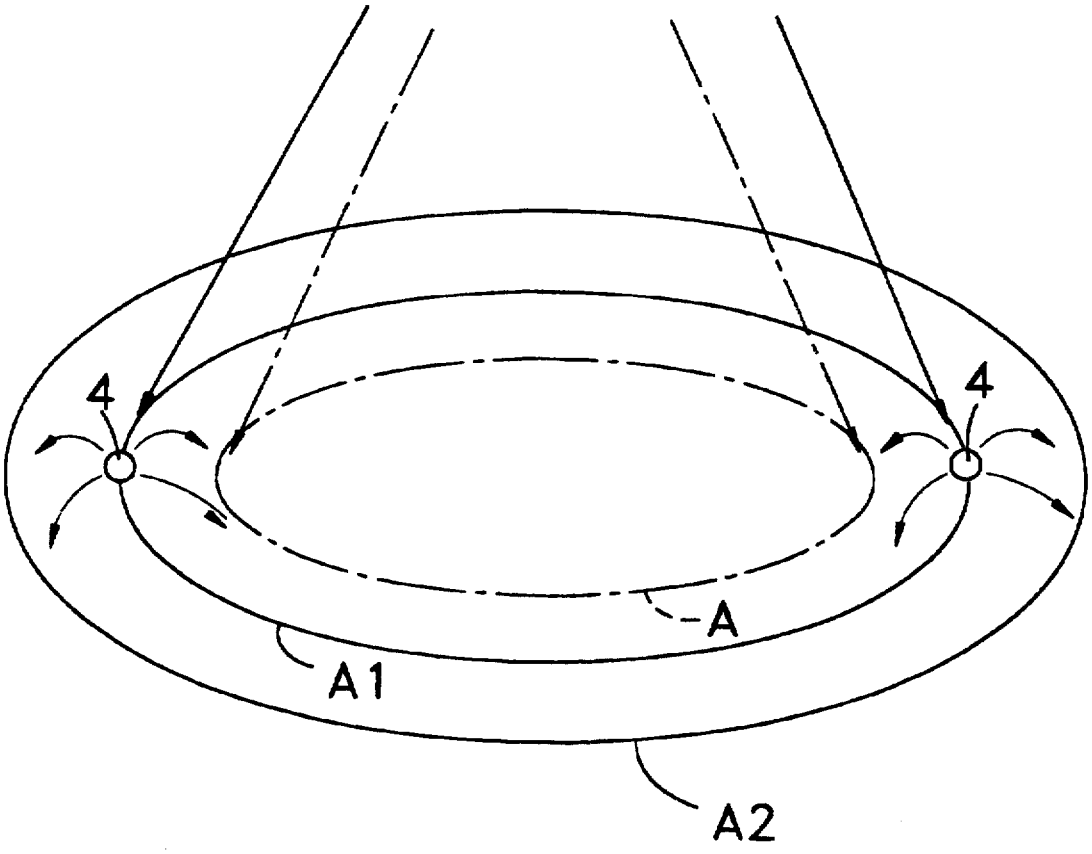
FIG. 5 is a perspective view showing the bouncing and spattering of the beads in a preferred embodiment of the present invention.

Referring further to FIG. 5, a conventional fire extinguishing bomb will explode with its chemicals falling generally downwards in the directions shown by the arrows in FIG. 1 and failing to spurt sidewards; and the chemical covering area, as shown by A in FIG. 1, is therefore limited. However, with the football shape designed in the present invention, the container (11) will explode in a wider range of directions to enlarge the covering area as (A1); furthermore, the beads (4) are preferably made of fracturable glass, as they fall on the ground and break, will allow the inner chemicals to spurt as shown by the arrows in FIG. 5 and further enlarge the covering area as A2.

The multiple beads (4) as well as the container (11) expanded outward at the central part provided in the present invention may achieve respectively the enlargement of the chemical covering area. It should therefore be understood that either of the two designs can be applied individually to a fire extinguishing bomb. Nevertheless, it is preferrably to apply both together, and the fire extinguishing chemicals (41) in the beads (4) is preferrably provided with a different type from that contained in the container (11) so as to extend the fire extinguishing effect.

According to the foregoing embodiments, it is known that anyone skilled in the art can make a modification or alteration to the fire extinguishing bomb, for example changing the shape of the bomb to a sphere, providing the bomb with only one holding part, or even omitting the holding parts and filling the container up with beads. Therefore it should be aware that the embodiments detailed in the specification are not to limit the scope of the appended claims.

What is claimed is:

1. An improved structure of fire extinguishing bombs comprising:

a sealed hollow container, wherein the central part is expanded outward and therefrom extended to both ends with gradual narrowing;

fire extinguishing chemicals filled in said container, which chemicals will expand their volume as they absorb heat to form a pressure bloating the central part of the container and explode it thereby; and multiple hollow beads containing respectively fire extinguishing chemicals, and provided within said container, said beads comprising respectively a hole into which said chemicals in said container can flow.

2. The improved structure of fire extinguishing bombs as claimed in claim 1, wherein said container is formed at both ends a holding part, said holding part is a casing with a protector.

3. The improved structure of fire extinguishing bombs as claimed in claim 2, wherein said protector is a metal cap.

4. The improved structure of fire extinguishing bombs as claimed in claim 1, wherein said container is made of heat-resisting fracturable glass with low expansion coefficient.

5. The improved structure of fire extinguishing bombs as claimed in claim 1, wherein said fire extinguishing chemicals is at least mixed with ammonium sulphate, urea, ammonium chloride and sodium carbonate.

6. The improved structure of fire extinguishing bombs as claimed in claim 1, wherein said beads are made of fracturable glass.

7. The improved structure of fire extinguishing bombs as claimed in claim 1, wherein said chemicals preserved in said beads is different from said chemicals contained in said container.

8. An improved structure of fire extinguishing bombs comprising:

a sealed hollow container;

fire extinguishing chemicals filled in said container; and multiple hollow beads containing respectively fire extinguishing chemicals, and provided within said container, said beads being provided with respectively a hole into which said chemicals in said container can flow.

9. The improved structure of fire extinguishing bombs as claimed in claim 8, wherein said container is made of heat-resisting glass with low expansion coefficient.

10. The improved structure of fire extinguishing bombs as claimed in claim 8, wherein said fire extinguishing chemicals is at least mixed with ammonium sulphate, urea, ammonium chloride and sodium carbonate.

11. The improved structure of fire extinguishing bombs as claimed in claim 8, wherein said chemicals preserved in said beads is different from said chemicals contained in said container.

* * * * *